US010212502B2

(12) United States Patent
Yoo

(10) Patent No.: US 10,212,502 B2
(45) Date of Patent: Feb. 19, 2019

(54) MICROPHONE HAVING A SOUND DELAY FILTER

(71) Applicants: Hyundai Motor Company, Seoul (KR); Kia Motors Corporation, Seoul (KR)

(72) Inventor: Ilseon Yoo, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/654,396

(22) Filed: Jul. 19, 2017

(65) Prior Publication Data

US 2018/0167709 A1 Jun. 14, 2018

(30) Foreign Application Priority Data

Dec. 13, 2016 (KR) ..... 10-2016-0169848

(51) Int. Cl.

| | |
|---|---|
| ***H04R 19/04*** | (2006.01) |
| ***H04R 1/08*** | (2006.01) |
| ***H04R 1/20*** | (2006.01) |
| ***H04R 3/04*** | (2006.01) |
| ***H04R 7/06*** | (2006.01) |

(52) U.S. Cl.

CPC ..... *H04R 1/083* (2013.01); *H04R 1/08* (2013.01); *H04R 1/20* (2013.01); *H04R 3/04* (2013.01); *H04R 7/06* (2013.01); *H04R 19/04* (2013.01); *H04R 2201/003* (2013.01); *H04R 2410/01* (2013.01)

(58) Field of Classification Search

CPC ..... H04R 1/083; H04R 1/20; H04R 1/342; H04R 3/04; H04R 19/005; H04R 19/016; H04R 19/04; H04R 31/006; H04R 2201/003; H04R 2410/01; B81B 2201/0257

USPC ..... 381/92, 113, 116, 355, 356, 357, 369, 381/174, 175, 191

See application file for complete search history.

(56) References Cited

U.S. PATENT DOCUMENTS

2007/0047744 A1* 3/2007 Harney ..... H04M 1/035 381/113
2016/0150319 A1* 5/2016 Yoo ..... H04R 19/005 381/92

(Continued)

FOREIGN PATENT DOCUMENTS

JP 2004-173053 A 6/2004
KR 10-1045517 B1 6/2011

(Continued)

*Primary Examiner* — Huyen D Le

(74) *Attorney, Agent, or Firm* — Mintz Levin Cohn Ferris Glovsky and Popeo, P.C.; Peter F. Corless

(57) ABSTRACT

A microphone having a plural porous sound delay filter is provided. The microphone includes a housing that has a first sound passage, a second sound passage and a third sound passage. A sound element is disposed in a position that corresponds to the first sound passage in the housing, and a semiconductor chip is electrically connected with the sound element in the housing. A low frequency lag filter is disposed in the second sound passage and delays low frequency sound source and a high frequency lag filter is disposed in third sound passage and delays high frequency sound source.

12 Claims, 3 Drawing Sheets

(56) References Cited

U.S. PATENT DOCUMENTS

| | | | | |
|---|---|---|---|---|
| 2017/0013355 | A1* | 1/2017 | Kim | H04R 1/406 |
| 2017/0094405 | A1* | 3/2017 | Yoo | H04R 1/326 |

FOREIGN PATENT DOCUMENTS

| | | | |
|---|---|---|---|
| KR | 10-1617660 | B1 | 5/2016 |
| KR | 10-1703628 | B1 | 2/2017 |

* cited by examiner

| Classification | Low frequency lag filter | | | Low frequency lag filter | | | Variation of directional difference | Polar pattern |
|---|---|---|---|---|---|---|---|---|
| | r(μm) | ℓ(μm) | Hole ratio(%) | r(μm) | ℓ(μm) | Hole ratio(%) | | |
| 1 | | | | 30 | | 4.5 | 10dB |  |
| 2 | 70 | 250 | 24.6 | 40 | 250 | 8 | 4dB |  |
| 3 | | | | 50 | | 12.5 | 9dB |  |

500Hz
1kHz
2kHz
4kHz
8kHz

MICROPHONE HAVING A SOUND DELAY FILTER

CROSS-REFERENCE TO RELATED APPLICATION

This application claims priority to and the benefit of Korean Patent Application No. 10-2016-0169848 filed in the Korean Intellectual Property Office on Dec. 13, 2016, the entire contents of which are incorporated herein by reference.

BACKGROUND (a) Field of the Disclosure

The present disclosure relates to a microphone and more particularly, to a microphone that improves directional characteristic by applying a plural porous sound delay filter.

(b) Description of the Related Art

Generally, a microphone is a device that converts sound into an electrical signal and is applicable to mobile communication devices that include a terminal (e.g., an earphone or a hearing aid). The microphone requires high audio performance, reliability, and operability. A capacitive microphone based on Micro Electro Mechanical System (MEMS microphone has high audio performance, reliability, and operability, as compared with an electret condenser microphone (ECM microphone). The MEMS microphone is classified into a non-directional (e.g., omnidirectional) microphone and a directional microphone based on the directional characteristics.

The directional microphone has varying sensitivity based on the directions of incident sound waves, and is a unidirectional or a bidirectional type in accordance with the directional characteristics. For example, the directional microphone is used for recording in a narrow room or capturing desired sounds in a room with reverberation. When the microphones are mounted within a vehicle, sound sources are distant and noise is variably generated due to the environmental characteristics of the vehicle.

Accordingly, there is a need for a microphone that filters the noise within the vehicle and it is desired that the directional MEMS microphone captures sounds in desired directions is used. However, there the directional microphone according to the conventional art does not have uniform directional difference based on the frequency bands.

The above information disclosed in this section is merely for enhancement of understanding of the background of the disclosure and therefore it may contain information that does not form the prior art that is already known in this country to a person of ordinary skill in the art.

SUMMARY

The present disclosure provides a microphone that improves directional characteristic by applying a plural porous sound delay filter.

A microphone according to an exemplary embodiment of the present disclosure may include a housing having a first sound passage, a second sound passage and a third sound passage and a sound element disposed in a position that corresponds to the first sound passage in the housing. The microphone may further include a semiconductor chip electrically connected with the sound element in the housing; a low frequency lag filter disposed in the second sound passage and configured to delay the low frequency sound source; and a high frequency lag filter disposed in third sound passage and configured to delay the high frequency sound source.

The housing may include a main board having the first sound passage formed therein and a cover coupled to the main board and that forms the second sound passage and the third sound passage. The main board and the cover may form a receiving cavity. Fitting grooves may be formed along a circumference of the second sound passage and the third sound passage for a predetermined section. The fitting grooves may be formed in an interior side or an exterior side of a top surface of the cover.

The low frequency lag filter and the high frequency lag filter may be inserted in the fitting groove and coupled to the housing. The low frequency lag filter may be regularly formed with a plurality of a low frequency filter apertures configured to delay the low frequency sound source that passes there through. A radius of the low frequency filter aperture may be equal or greater than about 70 μm, and less than about 80 μm. A distance between proximate centers of the low frequency filter apertures neighboring each other may be equal or greater than about 200 μm, and less than about 300 μm. An aperture ratio HRLow may be equal or greater than about 20%, and less than about 30%. The aperture ratio HRLow may be determined by the number of the low frequency filter apertures, an area of the low frequency filter aperture and an area of the second sound passage.

The aperture ratio may be HRLow=((A1Low*A2Low)/BLow)*100, wherein the HRLow denostes the aperture ratio of the low frequency filter aperture, the A1Low denotes number of the low frequency filter apertures, the A2Low denotes the area of the low frequency filter aperture and the Blow denotes the area of the second sound passage.

The high frequency lag filter may be formed with a plurality of a high frequency filter apertures that delay the passage of the high frequency sound source there through. A radius of the high frequency filter aperture may be equal or greater than about 35 μm and less than about 45 μm. A distance between proximate centers of the high frequency filter apertures may be equal or greater than 200 μm, and less than 300 μm. A aperture ratio HRHigh may be equal or greater than about 6%, and less than about 10%.

The aperture ratio HRHigh may be determined by number of the high frequency filter aperture, an area of the high frequency filter apertures and an area of the third sound passage. The aperture ratio HRHigh may be calculated using HRHigh=((A1High*A2High)/BHigh)*100, wherein the HRHigh denotes the aperture ratio of the high frequency filter aperture. The A1High denotes the number of the high frequency filter apertures. The A2High denotes the area of the high frequency filter aperture and the BHigh denotes the area of the third sound passage.

According to an exemplary embodiment of the present disclosure, stable directional difference may be achieved by applying two lag filter having a different range of filter apertures.

BRIEF DESCRIPTION OF THE DRAWINGS

The above and other objects, features and advantages of the present disclosure will be more apparent from the following detailed description taken in conjunction with the accompanying drawings, in which.

DETAILED DESCRIPTION

Figure 1:
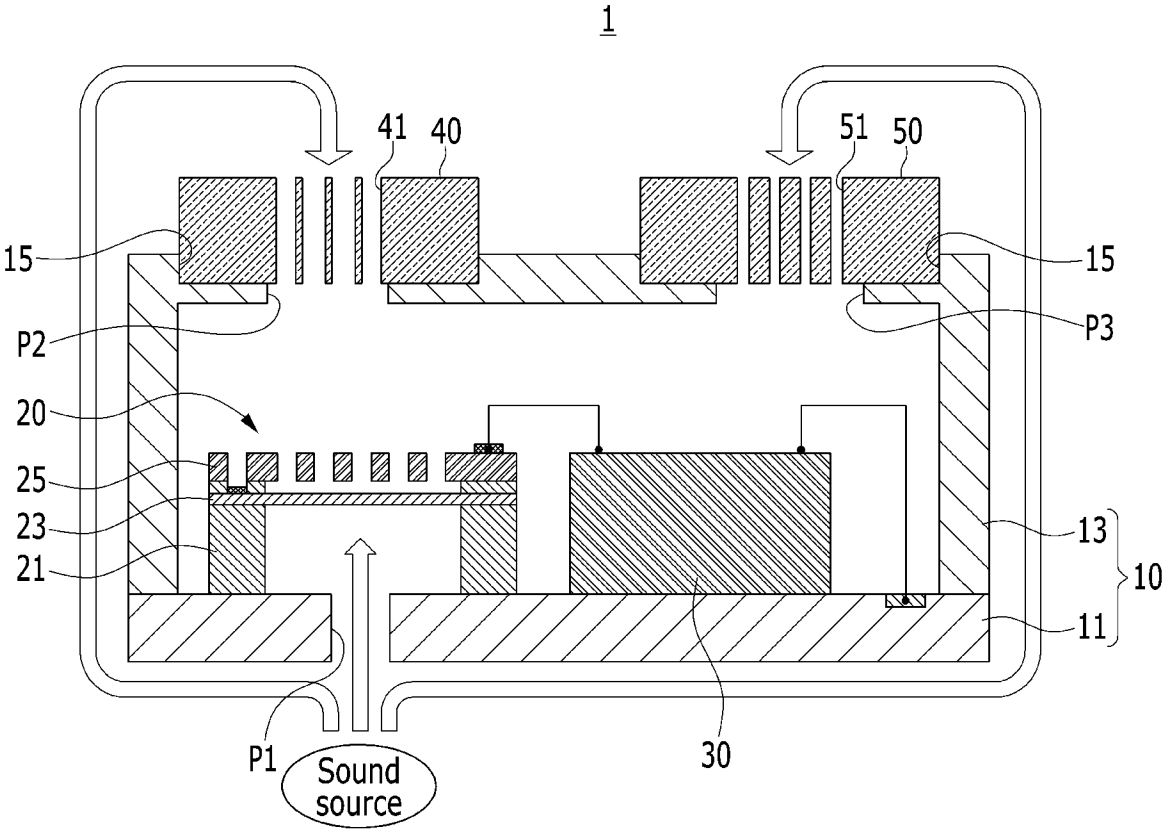
FIG. 1 is an exemplary schematic diagram illustrating a microphone according to an exemplary embodiment of the present disclosure.

Hereinafter, exemplary embodiments of the present disclosure will be described with reference to the accompanying drawings. However, the drawings to be described below and the following detailed description relate to one preferred exemplary embodiment of various exemplary embodiments for effectively explaining the characteristics of the present disclosure. Therefore, the present disclosure should not be construed as being limited to the drawings and the following description.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present disclosure clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Figure 2:
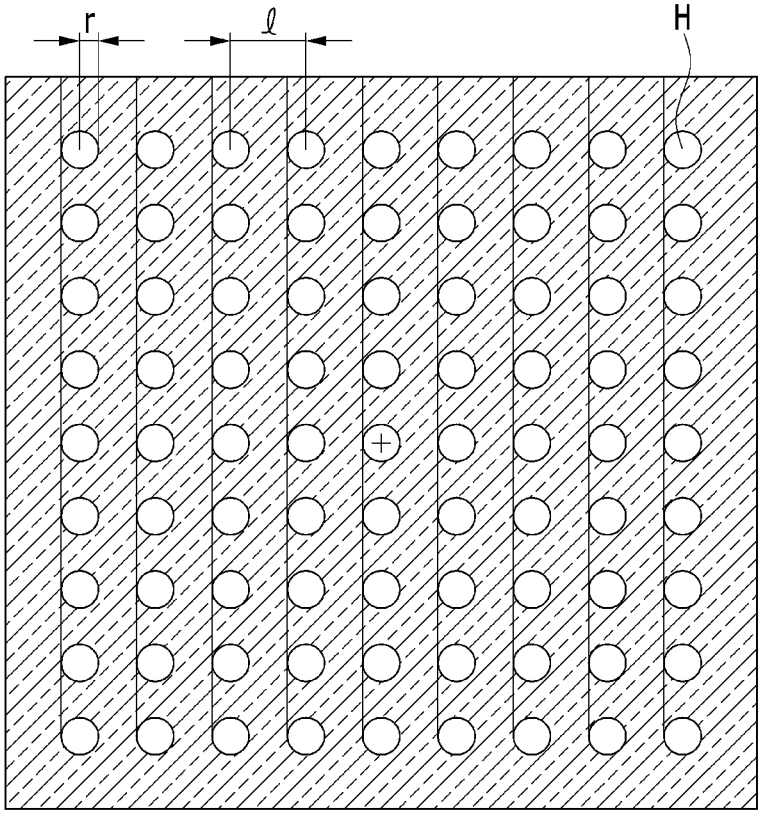
FIG. 2 is an exemplary schematic diagram for explaining a low frequency lag filter and a high frequency lag filter according to an exemplary embodiment of the present disclosure.
Figure 3:
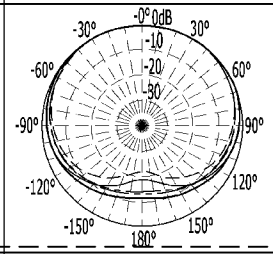
FIG. 3 is an exemplary experimental graph illustrating directional characteristic of a microphone according to an exemplary embodiment of the present disclosure.
Figure 3:
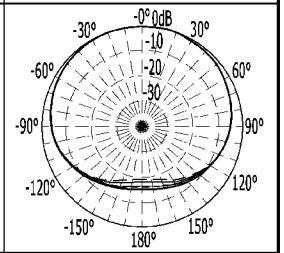
Figure 3:
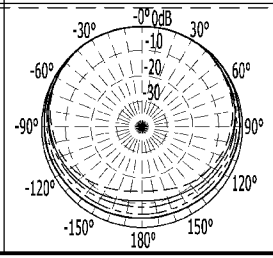

FIG. 1 is an exemplary schematic diagram illustrating a microphone according to an exemplary embodiment of the present disclosure. FIG. 2 is an exemplary schematic diagram of a low frequency lag filter and a high frequency lag filter according to an exemplary embodiment of the present disclosure. FIG. 3 is an exemplary experimental graph illustrating directional characteristic of a microphone according to an exemplary embodiment of the present disclosure.

In particular, the sound source that flows into the microphone according to an exemplary embodiment of the present disclosure will be described as an example of sound source having frequency in a range equal to or greater than about 20 Hz and or less than 20 kHz. Further, the sound source within a range of about 20 Hz-3 kHz may be classified as a low frequency and the sound source within a range of about 3 kHz-20 kHz may be classified as a high frequency.

Referring to FIG. 1, a microphone according to an exemplary embodiment of the present disclosure may be manufactured by Micro Electro Mechanical System (MEMS) technology. The microphone 1 may include a housing 10, a sound element 20, a semiconductor chip 30, a low frequency lag filter 40 and a high frequency lag filter 50. In particular, the housing 10 may include a main board 11 and a cover 13. The main board 11 may have a first sound passage P1 and may be a printed circuit board (PCB). The first sound passage P1 may be a passage through which sound from an external sound source flows into the housing 10. The cover 13 may be disposed on the main board 11 and may be formed from a metal material or the like. The housing 10 and the cover 13 may form a predetermined receiving cavity.

Further, a second sound passage P2 and a third sound passage P3 may be formed in the cover 13. The second sound passage P2 and the third sound passage P3 may be passages through which sound from an external sound source to flow into the housing 10. Fitting grooves 15 may be formed along a circumference of the second sound passage P2 and the third sound passage P3, respectively. In particular, the fitting groove 15 may be formed in an interior side of a top surface of the cover 13. Additionally, the fitting groove 15 may be formed in an exterior side of a top surface of the cover 13.

The sound element 20 may be coupled to the main board l land may be disposed to correspond to the first sound passage Pl. The sound element 20 may be configured to receive sound that flows in through the first sound passage P1, the second sound passage P2 and the third sound passage P3. The sound element 20 may include a sound board 21 formed with a sound aperture, a vibration membrane 23 disposed on the sound board 21 and a fixation membrane 25 disposed on the vibration membrane 23.

An exposed portion of the vibration membrane 23 by the sound aperture of the sound board 21 may vibrate by external sound. For example, when the vibration membrane 23 vibrates, the difference between the vibration membrane 23 and the fixation membrane 25 varies and a capacitance variation may be generated between the vibration membrane 23 and the fixation membrane 25. The capacitance varied by the sound element 20 that is transmitted to a semiconductor chip 30 will be described later.

The sound element 20 may be a capacitance type MEMS element based on the MEMS technology. The semiconductor chip 30 may be electrically connected with the sound element 20. For example, the semiconductor chip 30 may be electrically connected with the sound element 20 external to the receiving cavity of the housing 10. The semiconductor chip 30 may be configured to receive an acoustic output signal from the sound element 20 and transmit the acoustic output signal to the exterior. The semiconductor chip 30 may be an Application Specific Integrated Circuit (ASIC).

The low frequency lag filter 40 may be disposed above the sound element 20. The low frequency lag filter 40 may be position to correspond to the second sound passage P2 formed in the cover 13. For example, the sound that flows in to the second sound passage P2 passes through the low frequency lag filter 40. A low frequency sound having a low frequency band (e.g., about 20 Hz-3 kHz) may pass through the low frequency lag filter 40 and may delay the time required for the low frequency sound to reach the vibration membrane. The low frequency lag filter 40 may be inserted and coupled to a fitting groove 15 formed along circumference of the second sound passage P2.

Referring to FIG. 2, the low frequency lag filter 40 may be formed with a plurality of a low frequency filter apertures 41 and may be formed from a silicon material or the like. Referring to experimental data of FIG. 3, a radius (r) of the low frequency filter aperture 41 is equal to or greater than about 70 μm, and less than about 80 μm. Further, as shown in FIG. 3, a distance (l) between proximate centers of the low frequency filter apertures 41 is equal to or greater than about 200 μm and less than about 300 μm.

Further, an aperture ratio HRLow of the low frequency filter aperture 41 is equal to or greater than about 20% and less than about 30%. Herein, the aperture ratio HRLow indicates an area of the entire low frequency filter apertures 41 with respect to the second sound passage P2. The aperture ratio HRLow of the low frequency filter aperture 41 may be determined by the number of the low frequency filter apertures 41, an area of the low frequency filter aperture 41 and an area of the second sound passage P2.

The aperture ratio HRLow of the low frequency filter aperture 41 may be calculated from following equation 1.

$$HR_{Low} = \left(\frac{A1_{Low} \times A2_{Low}}{B_{Low}}\right) \times 100 \qquad \text{equation 1}$$

Wherein, the HRLow denotes the aperture ratio of the low frequency filter aperture 41, the A1Low denotes number of the low frequency filter aperture 41, the A2Low denotes the area of the low frequency filter aperture 41 and the BLow denotes the area of the second sound passage P2.

In an exemplary embodiment of the present disclosure, an area of the second sound passage P2 may be about 1.4 square millimeters. The high frequency lag filter 50 may be disposed adjacent to the low frequency lag filter 40 above the sound element 20. The high frequency lag filter 50 disposed to correspond to third sound passage P3 formed in the cover 13. Additionally, sound that flows to the third sound passage P3 may pass through the high frequency lag filter 50.

A high frequency sound having a low frequency band (e.g., about 3 kHz-20 kHz) passes through the high frequency lag filter 50 and may delay the time required for the high frequency sound to reach the vibration membrane. The high frequency lag filter 50 may be inserted to a fitting groove 15 formed along circumference of the third sound passage P3.

Referring to FIG. 2, the high frequency lag filter 50 may be formed with a plurality of a high frequency filter apertures 51 and may be formed from a silicon material or the like. Referring to FIG. 3, the radius (r) of the high frequency filter aperture 51 may be equal to or greater than about 35 μm, and may be less than about 45 μm. Further, a distance between proximate centers of the high frequency filter apertures 51 may be equal or greater than about 200 μm, and may be equal or less than about 300 μm.

Further, an aperture ratio HRHigh of the high frequency filter aperture 51 is equal or greater than about 6% and is less than about 10%. For example, the aperture ratio HRHigh indicates an area of the entire high frequency filter apertures 51 with respect to the third sound passage P3. In other words, the aperture ratio HRHigh of the high frequency filter aperture 51 may be determined by the number of the high frequency filter apertures 51, an area of the high frequency filter aperture 51 and an area of the third sound passage P3.

The aperture ratio HRHigh of the high frequency filter aperture 51 may be calculated from following equation 2.

$$HR_{High} = \left(\frac{A1_{High} \times A2_{High}}{B_{High}}\right) \times 100 \qquad \text{equation 2}$$

Wherein, the HRHigh denotes the aperture ratio of the high frequency filter aperture 51, the A1High denotes the number of the high frequency filter aperture 51, the A2High denotes the area of the high frequency filter aperture 51 and the BHigh denotes the area of the third sound passage P3.

In an exemplary embodiment of the present disclosure, an area of the third sound passage P3 may be 1.4 square millimeters. Referring to FIG. 3, a variation of directional difference becomes 4 dB when the radius (r) of the low frequency filter aperture 41 of the low frequency lag filter 40 is 75 μm, the distance (l) between centers of the low frequency filter aperture 41 is 250 μm, the aperture ratio (e.g., HRLow) of the low frequency filter aperture 41 is 24.6%, the radius (r) of the high frequency lag filter 50 is 40 μm, the distance (l) between centers of the high frequency filter aperture 51 is 250 μm and the aperture ratio (e.g., HRHigh) of the high frequency filter aperture 51 is 8%.

Particularly, the variation of the directional difference may be defined as a sensitivity difference between front 0 degree and rear 180 degree of the microphone. The means deviation may be determined in accordance with measurement of the frequency bands. In other words, when the variation of the directional difference is minimized, the deviation in accordance with measuring frequency bands is reduced and uniform directional difference in entire frequency band may be measured by the microphone.

Therefore, according to an exemplary embodiment of the present disclosure, the low frequency sound (e.g., about 20 Hz-3 kHz) may be configured to pass through the low frequency lag filter 40 and may delay time required for the low frequency sound to reach the vibration member. However, the low frequency sound (e.g., about 20 Hz-3 kHz) does not pass through the high frequency lag filter 50 otherwise, the magnitude of the low frequency sound (e.g., about 20 Hz-3 kHz) would be significantly decreased when the low frequency sound (e.g., about 20 Hz-3 kHz) passes through the high frequency lag filter 50. Similar to the above, the high frequency sound (e.g., about 3 kHz-20 kHz) may be configured to pass through the high frequency lag filter 50 and may delay the time required for the high frequency sound (e.g., about 3 kHz-20 kHz) to reach the vibration member. However, the high frequency sound (e.g., about 3 kHz-20 kHz) passes through the low frequency lag filter 40 without time delay.

Additionally, the sound element 20 may have a uniform directivity characteristic by combining sound inflowing to the sound element 20 that passes through the first sound passage P1, the sound that flows into the sound element 20 and passes through the low frequency lag filter 40 of the second sound passage P2 and sound that flows in to the sound element 20 and passes through the high frequency lag filter 50 of the third sound passage P3.

While this disclosure has been described in connection with what is presently considered to exemplary embodiments, it is to be understood that the disclosure is not limited to the disclosed exemplary embodiments, but, on the contrary, is intended to cover various modifications and equivalent arrangements included within the spirit and scope of the appended claims

DESCRIPTION OF SYMBOLS

1: microphone
10: housing
11: main board
13: cover
15: fitting groove
P1: first sound passage
P2: second sound passage
P3: third sound passage
20: sound element
21: sound board
23: vibration membrane
25: fixation membrane
30: semiconductor chip
40: low frequency lag filter
41: low frequency filter aperture
50: high frequency lag filter
51: high frequency filter aperture

What is claimed is:

1. A microphone, comprising:
a housing having a first sound passage, a second sound passage, and a third sound passage;
a sound element disposed in a position that corresponds to the first sound passage in the housing;
a semiconductor chip electrically connected with the sound element in the housing;
a low frequency lag filter disposed in the second sound passage and configured to delay a low frequency sound source; and
a high frequency lag filter disposed in third sound passage and configured to delay a high frequency sound source,
wherein the housing includes;
a main board having the first sound passage formed therein; and
a cover assembled to the main board that forms the second sound passage and the third sound passage,
wherein the main board and the cover form receiving cavity.

2. The microphone of claim 1, wherein fitting grooves are formed along a circumference of the second sound passage and the third sound passage for a predetermined section.

3. The microphone of claim 2, wherein the fitting grooves are formed in an interior side or an exterior side of a top surface of the cover.

4. The microphone of claim 3, wherein the low frequency lag filter and the high frequency lag filter are inserted in the fitting groove and fixed to the housing.

5. The microphone of claim 1, wherein the low frequency lag filter is formed with a plurality of a low frequency filter apertures configured to delay the passage of the low frequency sound source there through.

6. The microphone of claim 5, wherein:
a radius of the low frequency filter aperture equal to or greater than about 70 μm, and less than about 80 μm,
a distance between proximate centers of the low frequency filter apertures equal to or greater than about 200 μm, and less than about 300 μm, and
an aperture ratio HRLow equal to or greater than about 20%, and less than about 30%.

7. The microphone of claim 6, wherein the aperture ratio HRLow is determined by a number of the low frequency filter apertures, an area of the low frequency filter aperture and an area of the second sound passage.

8. The microphone of claim 7, wherein the aperture ratio is calculated from an equation of:

$$HR\text{Low}=((A1\text{Low}*A2\text{Low})/B\text{Low})*100,$$

wherein the HRLow is the aperture ratio of the low frequency filter aperture, the A1Low is the number of the low frequency filter aperture, the A2Low is the area of the low frequency filter aperture, and the Blow is the area of the second sound passage.

9. The microphone of claim 1, wherein the high frequency lag filter is formed with a plurality of a high frequency filter apertures configured to delay the passage of the high frequency sound source there through.

10. The microphone of claim 9, wherein:
a radius of the high frequency filter aperture equal to or greater than about 35 μm, and less than about 45 μm,
a distance between proximate centers of the high frequency filter apertures equal or greater than 200 μm, and equal or less than 300 μm, and
an aperture ratio HRHigh is equal or greater than 6%, and equal or less than 10%.

11. The microphone of claim 10, wherein the aperture ratio HRHigh is determined by the number of the high frequency filter apertures, an area of the high frequency filter aperture and an area of the third sound passage.

12. The microphone of claim 11, wherein the aperture ratio HRHigh is calculated an equation of:

$$HR\text{High}=((A1\text{High}*A2\text{High})/B\text{High})*100,$$

wherein the HRHigh is the aperture ratio of the high frequency filter aperture, the A1High is the number of the high frequency filter apertures, the A2High is the area of the high frequency filter aperture, and the BHigh is the area of the third sound passage.

* * * * *